US007313899B2

(12) United States Patent
Murray

(10) Patent No.: US 7,313,899 B2
(45) Date of Patent: Jan. 1, 2008

(54) FLEXIBLE POUCH AND METHOD OF FORMING A FLEXIBLE POUCH

(75) Inventor: R. Charles Murray, Sarasota, FL (US)

(73) Assignee: Pouch Pac Innovations, LLC, Sarasota, FL (US)

( * ) Notice: Subject to any disclaimer, the term of this patent is extended or adjusted under 35 U.S.C. 154(b) by 456 days.

(21) Appl. No.: 11/435,227

(22) Filed: Sep. 27, 2004

(65) Prior Publication Data

US 2007/0144113 A1 Jun. 28, 2007

Related U.S. Application Data

(62) Division of application No. 10/310,221, filed on Dec. 5, 2002, now abandoned.

(60) Provisional application No. 60/339,993, filed on Dec. 10, 2001.

(51) Int. Cl.
*B65B 43/34* (2006.01)

(52) U.S. Cl. ..... 53/410; 53/459; 53/469; 53/473

(58) Field of Classification Search ..... 53/385.1
See application file for complete search history.

(56) References Cited

U.S. PATENT DOCUMENTS 3,855,907 A * 12/1974 Johnson et al. ..... 493/235
4,078,717 A * 3/1978 Stearley ..... 383/35
4,498,591 A * 2/1985 Smith, II ..... 383/209
5,433,526 A * 7/1995 Wild ..... 383/35
6,199,601 B1 * 3/2001 Laudenberg ..... 141/48

* cited by examiner

*Primary Examiner*—John Sipos
(74) *Attorney, Agent, or Firm*—Gifford, Krass, Sprinkle, Anderson & Citkowski, P.C.

(57) ABSTRACT

A flexible pouch for packaging a product includes a front panel and a back panel, each having an upper edge, a lower edge opposite the upper edge, and side edges extending therebetween the upper and lower edges, that are joined together at the side edges and the lower edges to contain the product. The front and back panels include an outwardly projecting crease that forms a guide pocket for separating the panels, prior to filling the pouch with the product, and the crease is straightened out when the upper edges of the front panel and back panel are sealed together. A method of forming and filling the flexible pouch includes the steps of forming the panel, and forming a crease in each of the panels that projects outwardly and extends longitudinally along each of the panels. The method also includes the steps of joining the two panels by sealing together their side edges and lower edge, such that the crease in one panel opposes the crease in the other panel, to form a guide pocket, and separating the two panels by forcing apart the guide pocket. The method further includes the steps of filling the pouch with the product and finishing the pouch by sealing together the upper edges of the two panels, such that the crease in each of the panels is straightened out as the upper edges are sealed.

14 Claims, 3 Drawing Sheets

FLEXIBLE POUCH AND METHOD OF FORMING A FLEXIBLE POUCH

RELATED APPLICATIONS

This application is a divisional of U.S. Ser. No. 10/310,221 filed Dec. 5, 2002, now abandoned which claims priority of U.S. Provisional Patent Application Ser. No. 60/339,993 filed Dec. 10, 2001.

BACKGROUND OF THE INVENTION

1. Field of the Invention

The present invention relates generally to flexible pouches for packaging a product and, more specifically, to a flexible pouch for packaging a product, and a method of manufacturing the same.

2. Description of the Related Art

Various types of disposable, portable containers are known in the art for storing a fluid or dry product, such as a liquid, granular material, powder or the like. One example of such a container is a flexible pouch. Consumers prefer the convenience of flexible pouches, due to their shape and size. Manufacturers recognize the packaging benefits of a flexible pouch, since the pouch can be formed and filled on the same manufacturing line. An example of a method and apparatus for filling a flexible pouch with a product is disclosed in commonly assigned U.S. Pat. No. 6,199,601, which is incorporated herein by reference.

The flexible pouch is made from a flexible material, preferably a laminate composed of sheets of plastic or aluminum or the like. In this example, the material is available in sheet form, on a roll. An outer layer of the material may include preprinted information, such as a logo, or the like, to provide the consumer with information regarding the contents of the pouch. The pouch may be formed using conventionally known manufacturing techniques, such as a horizontal form-fill seal machine, a flat bed pre-made pouch machine, a vertical form fill machine, or the like. The pouch is generally formed by folding sheets of material over each other to achieve a predetermined shape. Edges, such as a side edge, are joined together using a joining technique such as bonding or welding. Alternatively, the pouch is formed by laying one layer of material over a second layer of material and forming a gusset along two parallel edges to form a pouch capable of standing unsupported. An upper edge of the front panel and back panel is generally not sealed, until after the pouch is filled. The empty pouch may be placed in a holder such as a cup or puck prior to the filling process. To fill the pouch, the upper edges of the pouch are spread apart. For example, a concentrated flow of gas is directed towards the upper edge of the pouch to separate the panels. Grippers may also be utilized at the same time to pull the panels apart. However, this is not a reliable method of separating the panels, since the degree of surface tension between the two panels may prevent the jet flow of gas from properly separating the panels. Thus, there is a need in the art force for a flexible pouch that can be reliably opened for filling purposes, and a method of making an easy open pouch.

SUMMARY OF THE INVENTION

Accordingly, the present invention is a flexible pouch and an improved method for manufacturing and filling the pouch. The pouch includes a front panel and a back panel, each having an upper edge, a lower edge opposite the upper edge, and side edges extending therebetween the upper and lower edges, that are joined together at the side edges and the lower edges to contain the product. The front and back panels include an outwardly projecting crease that forms a guide pocket for separating the panels prior to filling the pouch with the product, and the crease is straightened out when the upper edges of the front panel and back panel are sealed together.

A method of forming and filling the flexible pouch includes the steps of forming the panel, and forming a crease in each of the panels that projects outwardly and extends longitudinally along each of the panels. The method also includes the steps of joining the two panels by sealing together their side edges and lower edges, such that the crease in one panel opposes the crease in the other panel, to form a guide pocket, and separating the two panels by forcing apart the guide pocket. The method further includes the steps of filling the pouch with the product and finishing the pouch by sealing together the upper edges of the two panels, such that the crease in each of the panels is straightened out as the upper edges are sealed.

One advantage of the present invention is that a flexible pouch made from panels having an improved shape is provided to facilitate separating the panels, prior to filling the pouch. Another advantage of the present invention is that an upper edge of each panel includes a crease, to create a guide pocket for directing a jet flow of gas into the pouch to open the pouch. Still another advantage of the present invention is that the flexible pouch is more cost-effective to manufacture, since the step of opening the pouch is more reliably performed. A further advantage of the present invention is that the creases in the panels of the pouch facilitate the separation of the front and back panels prior to filling the pouch with the product.

Other features and advantages of the present invention will be readily appreciated, as the same becomes better understood after reading the subsequent description taken in conjunction with the accompanying drawings.

DESCRIPTION OF THE PREFERRED EMBODIMENT(S)

Figure 1:
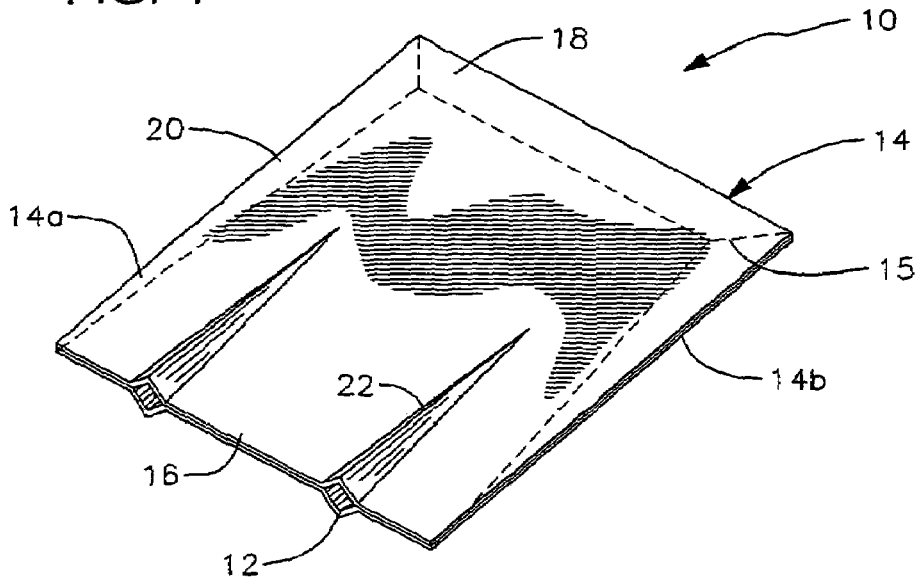
FIG. 1 is a perspective view of an unopened flexible pouch, according to the present invention.

Referring to FIG. 1, an unfilled, flexible pouch 10 is illustrated. The pouch 10 is filled with a product (not shown) and sealed. Various fluid and dry products are contemplated, such as juice, chips, dog food, shredded cheese, or the like. The flexible pouch 10 advantageously includes a guide pocket 12 formed in a panel 14 or wall of the pouch 10, to facilitate the separation of the front and back panels 14*a*, 14*b* prior to the filling of the pouch.

The pouch 10 includes a front panel 14*a* and a back panel 14*b* that are joined together in a manner to be described, to form a pouch 10 having an upper edge 16, a lower edge 18, and two side edges 20. In this example, each panel 10 has a generally rectangular shape, although other shapes are contemplated. Further, the panel is defined by an upper edge 16, an opposed lower edge 18, and side edges 20 extending therebetween the upper and lower edges 16, 18. The pouch 10 may include a side wall 15 disposed between the side edges and lower edge, which allows the pouch 10 to stand upright. For example, the sidewall may form a gusset may be formed in the side walls, which is generally wider at the lower edge, and tapers upwardly towards the upper edge.

The front panel 14*a* and back wall 14*b* each include at least one outwardly projecting V-shaped crease 22. In this example each panel includes two spaced-apart creases 22. Each crease 22 extends longitudinally therealong the panel 14, with the widest portion of the "V" shape at the upper edge 16 of the panel 14, and tapering to a point towards the lower edge 18 of the panel 14. The overall length of the crease 22 from the upper edge 16*a* is a predetermined distance, such as a half-inch.

The location of the crease 22 in the front panel preferably corresponds with the location of the crease 22 in the back panel 14*b*. Thus, when the upper edge portions of the front and back panels 14*a*, 14*b* are positioned to face each other, a diamond shaped guide pocket 12, in cross-section, is formed by the opposed V-shaped creases.

It should be appreciated that the pouch 10 may include other components or features, as is known in the art. For example, a dimple (not shown) may be found in a panel 14 for receiving a straw. An upper edge 16 of the panel 14 may include a weakened area, to facilitate opening the pouch 10.

Figure 2:
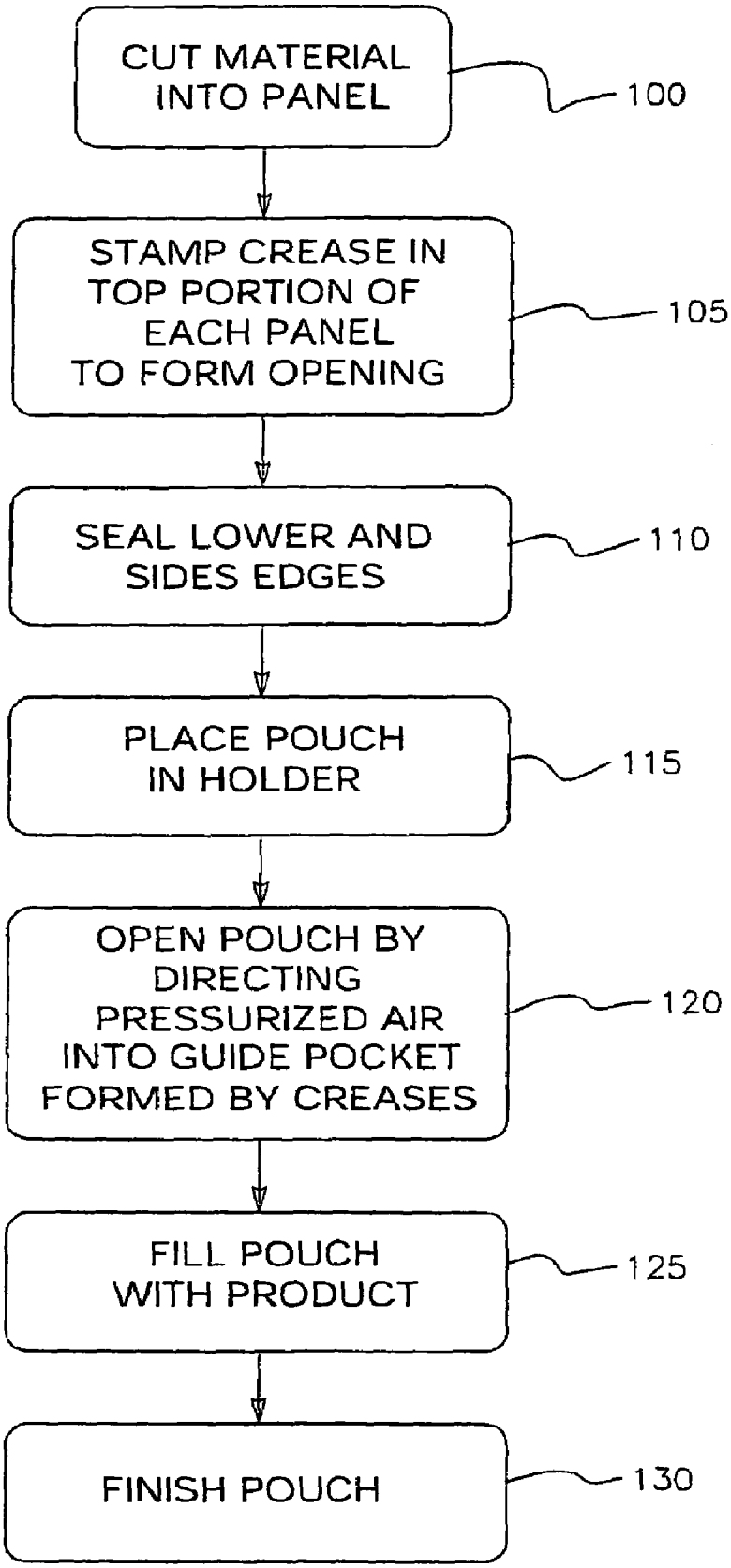
FIG. 2 a flowchart of a method of forming and filling a flexible pouch, according to the present invention.

A method of forming and filling a flexible pouch 10 for packaging a product, is illustrated in FIG. 2. The method begins in block 100 with the step of forming the panels that define the walls of the pouch 10 in a panel cutting operation. For example, the panels 14 are formed from a preprinted laminate of material, in a conventional manner. Each layer of laminate is a sheet of flexible material, such as polypropylene, aluminum or the like. One layer of the material is preferably preprinted with information or locating indicia 24, such as a registration mark. The registration marks 24 are located on the material to denote an edge of a panel 14. The registration marks 24 are read by an optical reading device, such as a scanner, to index the material in a predetermined position at the cutting station. The preprinted information may include labeling information that describes the product contained within the pouch. In this example, the layer of preprinted information is located on an outer layer of the material. The material is removed from the roll and cut into panels 14. Each panel 14 has a predetermined shape, which in this example is a rectangle. The material is cut into a panel 14 using a known cutting apparatus, such as a laser or punch or the like. The methodology advances to block 105.

Figure 3:
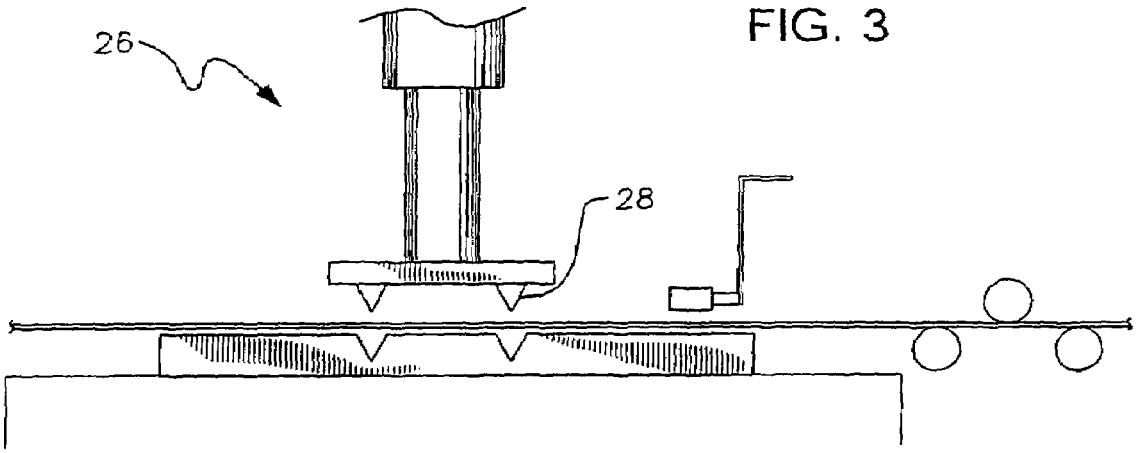
FIG. 3 is an elevational view of a station for forming a crease in a panel of the pouch of FIG. 1, according to the present invention.

In block 105, a crease 22 is formed in a top portion of each panel 14 in a creasing operation. A forming technique, such as stamping, may be utilized. For example, as shown in FIG. 3, a creasing station 26 may include a die 28 having a predetermined shape. The panel 14 may be aligned within the station 26 using the registration marks 24 on the panel 14. Another example of a forming technique is the use of heated tubes that thermoform a crease 22 in each panel 14.

Figure 4:
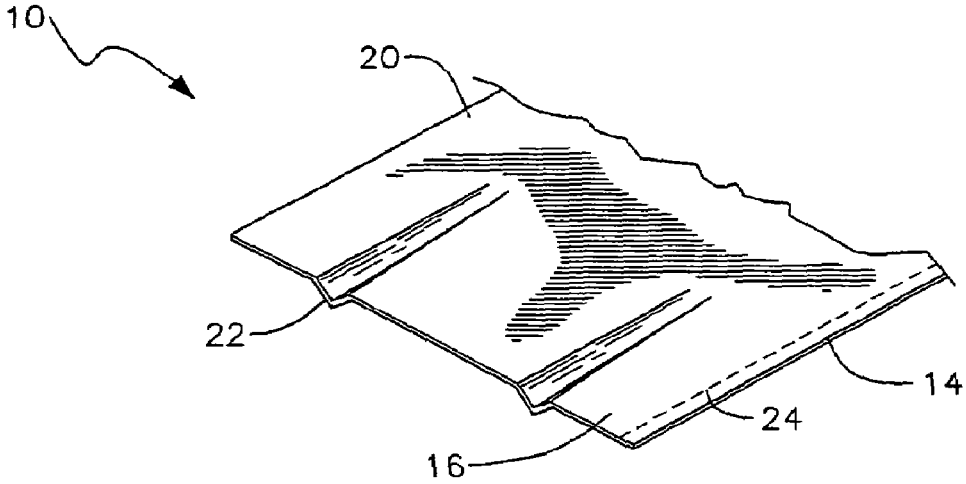
FIG. 4 is a perspective view of the panel formed in FIG. 3, according to the present invention.

When in registration, the upper edge 16 of each panel 14 is positioned between one or more lower dies and corresponding diving upper dies. The upper die is mechanically moved first downwardly and then upwardly to stamp the predetermined shape into the top portion of each panel 14. In this example, the predetermined shape is a crease 22 having a "V" configuration, with the open portion of the "V" at the upper edge of the panel 14, and extending longitudinally along the panel 14 with the point of the "V" towards the lower edge of the panel 14, as shown in FIG. 4.

The method advances to block 110, and the lower and side edges 18, 20 of the pouch 10 are joined together in a joining operation. In this example, the edges 18, 20 are joined together using a conventionally known sealing process, such as the application of heat and compression.

The methodology advances to block 115, and the pouch 10 is prepared for filling. In this example, the pouch 10 is placed in a holder 32. An example of a holder 32 is a cup-shaped member. Alternatively, the pouch 10 may be held with grippers (not shown) as is known in the art. The methodology advances to block 120.

Figure 5:
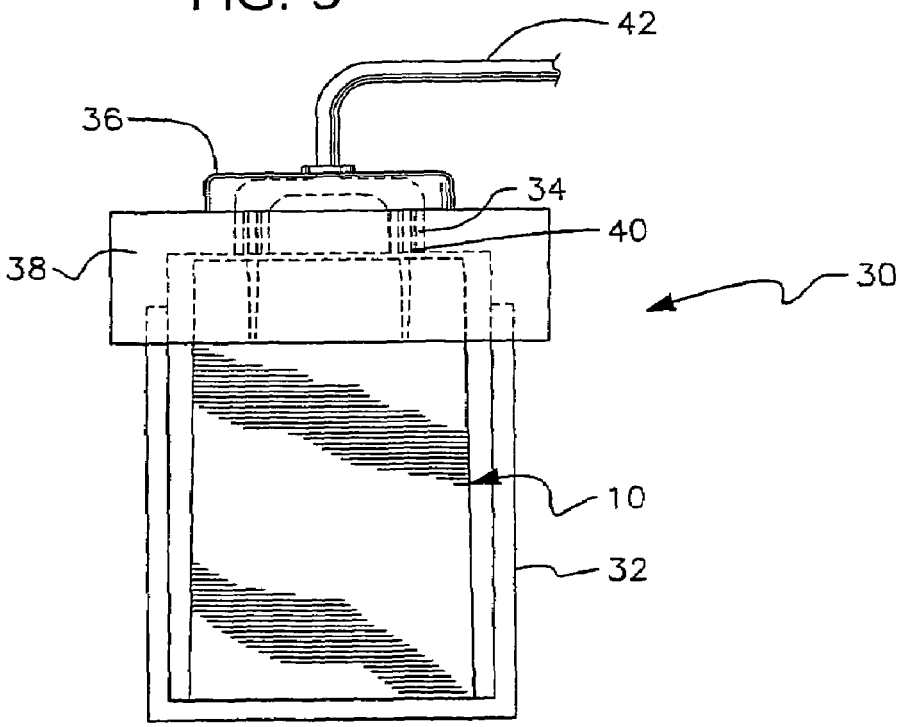
FIG. 5 is an elevational view of a station for opening and filling the pouch, according to the present invention.

In block 120, the pouch 10 is opened using the guide pocket 12 formed by the crease 22 in the front panel 14*a* and back panel 14*b* in an opening operation 30 as shown in FIG. 5. Various techniques are conventionally known in the art for opening the pouch 10. For example, a nozzle 34 may be mechanically lowered into the guide pocket 12 to direct a stream of compressed gas into the guide pocket 12, to force the walls of the pouch 10 away from each other, as shown in FIG. 5. An example of a gas is carbon dioxide or nitrogen. The blowing station 30 may include a manifold 36, with a hood 38 extending over the top of the edges of the pouch as shown in FIG. 5. The manifold 36 has rows of apertures (not shown) formed above the upper edges 16 of the panels 14 of the pouch 10. The hood 38 is placed over the pouch 10 to assist in maintaining the air pressure in the pouch 10. The supply of pressurized gas is directed through the aperture to form a plurality of jets of pressurized gas or air. The jets are directed downwardly at the diamond-shaped openings formed at the upper edges 16 to assist in overcoming the surface tension of the panels 14 and assist in separation of the panels 14. A diving rod 40 may then be used to make sure the pouch 10 is fully opened. The methodology advances to block 125.

In block 125, the opened pouch 10 is filled with the product in a filling operation. For example, a fill tube 42 is lowered into the opened pouch 10 and the product is dispensed into the open pouch 10. The methodology advances to block 130.

In block 130, the pouch 10 is finished in a finishing operation. For example, the pouch 10 is finished at a sealing station, where the upper edges 16 of the pouch 10 are sealed together using a conventionally known sealing technique. For example, the upper edges 16 are sealed together using a combination of heat and pressure. Another example of a sealing technique is an ultrasonic sealing process. It should be appreciated that the sealing process removes the creases 22 from the panel 14. In this way a novel pouch making apparatus and method of forming the same, is provided.

It should be appreciated that the methodology may include other steps, such as a straw piercable opening station, an upstream oxygen purging station, a downstream oxygen purging station, or the like. In addition, a manufacturing station may perform one or a plurality of operations, to enhance the efficiency of the methodology.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A method of forming, filling, and sealing a flexible pouch for packaging a product, said method comprising the steps of:

forming a front panel and a back panel, wherein each panel is rectangular and includes an upper edge, a lower edge opposite the upper edge, and a side edge extending therebetween the upper edge and lower edge;

forming a crease in each panel, wherein the crease in each panel projects outwardly and extends longitudinally from the upper edge of each panel, tapering towards the lower edge of each panel;

joining the front panel to the back panel by sealing together the side edge and lower edge of each panel, wherein the crease in the front panel opposes the crease in the back panel, to form a guide pocket between the front panel and the back panel;

opening the pouch by blowing a stream of gas at the guide pocket to separate the front panel upper edge from the back panel upper edge;

filling the pouch with the product through the separated front panel upper edge and back panel upper edge; and closing the pouch by sealing together the upper edge of each panel transversely through the guide pocket, wherein the crease in each panel is eliminated as the upper edge of each panel is sealed.

2. A method as set forth in claim 1, wherein each panel is formed from a laminate material having a preprinted locating indicia for defining the upper edge, lower edge and side edge of each panel.

3. A method as set forth in claim 1 wherein the crease has a generally "V" shape and extends longitudinally along the panel, with a widest portion of the "V" at the upper edge of the panel and tapering to a point towards the lower edge of the panel.

4. A method as set forth in claim 1 wherein said step of joining the front and to the back panel further includes the step of sealing the side edge or lower edge using a combination of heat and pressure.

5. A method as set forth in claim 1 further including the step of preparing the pouch for filling by placing the pouch in a holder having a cup shape.

6. A method as set forth in claim 1 wherein said step of opening the pouch further includes the step of directing a stream of compressed gas into the guide pocket to forcibly separate the front panel upper edge from the back panel upper edge.

7. A method as set forth in claim 6 further including the step of placing a rod in the opened pouch to hold the pouch in a fully opened positioned.

8. A method as set forth in claim 1 wherein said step of closing the pouch further includes the step of sealing the upper edge of each panel together using a combination of heat and pressure.

9. A method of forming, filling, and sealing a flexible pouch for packaging a product, said method comprising the steps of:

forming a front panel and a back panel wherein each panel is rectangular and includes an upper edge, a lower edge opposite the upper edge, and a side edge extending therebetween the upper edge and lower edge;

forming a crease in each panel, wherein the crease in each panel projects outwardly and has a generally "V" shape that extends longitudinally from the upper edge of each panel, with a widest portion of the "V" at the upper edge of each panel and tapering to a point towards the lower edge of each panel;

joining the front panel to the back panel by sealing together the side edge and lower edge of each panel, wherein the crease in the front panel opposes the crease in the back panel, to form a guide pocket between the front panel and the back panel;

separating the front panel from the back panel by directing a stream of gas into the guide pocket to forcibly separate the front panel upper edge from the back panel upper edge;

filling the pouch with the product through the separated front panel upper edge and back panel upper edge; and closing the pouch by sealing together the upper edge of each panel transversely through the guide pocket, wherein the crease in each panel is eliminated.

10. A method as set forth in claim 9, wherein each panel is formed from a laminate material having a preprinted locating indicia for defining the upper edge, lower edge and side edge of each panel.

11. A method as set forth in claim 10 wherein said step of joining the lower and side edges of the pouch together includes the step of sealing the edges using a combination of heat and pressure.

12. A method as set forth in claim 11 further including the step of preparing the pouch for filling by placing the pouch in a holder having a cup shape.

13. A method as set forth in claim 12 further including the step of placing a hood with a rod in the opened pouch to hold the pouch in a fully opened position.

14. A method as set forth in claim 13 wherein said step of closing the pouch further includes the step of sealing the upper edge of each panel together using an ultrasonic sealing mechanism.

* * * * *